US009526966B2

(12) United States Patent
White

(10) Patent No.: US 9,526,966 B2
(45) Date of Patent: Dec. 27, 2016

(54) WEIGHT LIFTING APPARATUS

(71) Applicant: Timothy White, Maybee, MI (US)

(72) Inventor: Timothy White, Maybee, MI (US)

( * ) Notice: Subject to any disclaimer, the term of this patent is extended or adjusted under 35 U.S.C. 154(b) by 0 days.

(21) Appl. No.: 14/244,939

(22) Filed: Apr. 4, 2014

(65) Prior Publication Data

US 2015/0283449 A1 Oct. 8, 2015

(51) Int. Cl.
*A41F 9/00* (2006.01)
*A63B 71/00* (2006.01)
*A44B 11/12* (2006.01)

(52) U.S. Cl.
CPC ..... *A63B 71/0054* (2013.01); *A41F 9/002* (2013.01); *A44B 11/12* (2013.01)

(58) Field of Classification Search
CPC ..... A41F 9/025; A41F 9/002; A41F 9/02; A41F 9/028; A44B 11/24; A44B 11/12; A63B 71/0054
USPC ... 2/311, 317, 322, 333, 338, 325, 342, 312; 24/33 L, 69 R, 271, 316, 177, 270; 602/19
See application file for complete search history.

(56) References Cited

U.S. PATENT DOCUMENTS 318,053 A * 5/1885 Thurlow ..... A44B 11/12 24/170
1,055,045 A * 3/1913 Hunter ..... A44B 11/22 24/176
2,394,078 A * 2/1946 Krupp ..... A62B 17/00 2/2.14
3,633,956 A * 1/1972 Angell ..... B65D 45/345 24/271
4,470,177 A * 9/1984 Ganung ..... A62C 33/04 24/270
4,527,289 A * 7/1985 Shea ..... A41F 9/002 2/322
4,541,152 A * 9/1985 DiMarco et al. ..... 24/271
5,036,864 A * 8/1991 Yewer, Jr. ..... A41F 9/002 128/876
5,269,050 A * 12/1993 Yewer, Jr. ..... A44B 11/12 128/876

* cited by examiner

*Primary Examiner* — Anna Kinsaul
*Assistant Examiner* — Jillian K Pierorazio
(74) *Attorney, Agent, or Firm* — Dinsmore & Shohl LLP

(57) ABSTRACT

A buckle system for a weight belt having a first end and a second end includes a first linkage member fixedly attachable to the first end of the weight belt. A second linkage member is removably attachable to the second end of the weight belt. A middle linkage member having a free end, a middle portion, and a pivot end is provided. The first linkage member is pivotally attached to the middle linkage member at the middle portion of the middle linage member. The second linkage member is pivotally attached to the pivot end of the middle linkage member. Actuation of the free end of the middle linkage member from a first position to a second position causes the buckle system to be transitioned from an open position to a closed position, thereby tightening the weight belt when the first linkage member is attached to the first end of the weight belt, and second linkage member is attached to the second end of the weight belt.

5 Claims, 7 Drawing Sheets

WEIGHT LIFTING APPARATUS

FIELD OF THE INVENTION

The present invention relates to fitness and athletic equipment, specifically to a weight belt and buckle for providing support to a user's torso while lifting weights.

BACKGROUND OF THE INVENTION

Weight belts have been used by weight lifters for quite some time. They are typically a wide belt fashioned of layers of leather or other flexible material such as rubber, synthetic leather, etc. The weight belt fits snuggly around a user's midsection and is tightly secured to provide support to the user's back and internal organs which helps prevent injury while the user is performing various workout and weight lifting activities such as doing squats or deep knee bends.

Various buckling mechanisms for weight belts have been utilized including a traditional buckle and notch, a winch type closure, a ratcheting linkage, and others known to those skilled in the art.

All of these previous buckle systems suffer from the same deficiency, namely that they do not provide a buckle and tightening system that can be easily sized for users of different sizes while at the same time allow the buckle to be quickly detached and the belt removed. As such, a new buckle design to solve the above problems is desired.

SUMMARY OF THE INVENTION

The present invention for a buckle system for a weight belt includes a first linkage member which is fixedly attachable to a first end of a weight belt, a second linkage member which is removably attachable to the second end of the weight belt, and a middle linkage member having a free end, a middle portion, and a pivot end.

The first linkage member is pivotally attached to the middle linkage member at the middle portion of the middle linkage member.

The second linkage member is pivotally attached to the pivot end of the middle linkage member.

When the first linkage member is attached to the first end of the weight belt and the second linkage member is attached to the second end of the weight belt, the free end of the middle linkage member can be actuated from a first position to a second position. Actuating the middle linkage member from the first position to the second position causes the buckle system to transition from an open position to a closed position thereby tightening the weight belt to which it is attached.

With the above described arraignment, the second end of the weight belt is disposed under the first end of the weight belt in area that does not interfere with the buckle system when the weight belt is worn by the user. Thereby enabling this unique linkage arrangement of the buckle system which allows for the weight belt to be quickly and easily tightened and released while at the same time providing a weight belt which is adjustable in size.

The second linkage member can further include at least one L-shaped extension. This L-shaped extension is received by a hole in the weight belt allowing the second linkage to be removably attached to the weight belt. Providing a plurality of holes in the weight belt allows the second linkage to be attached at various locations thereby providing different sizes of the weight belt.

DETAILED DESCRIPTION OF THE PREFERRED EMBODIMENTS

Figure 1:
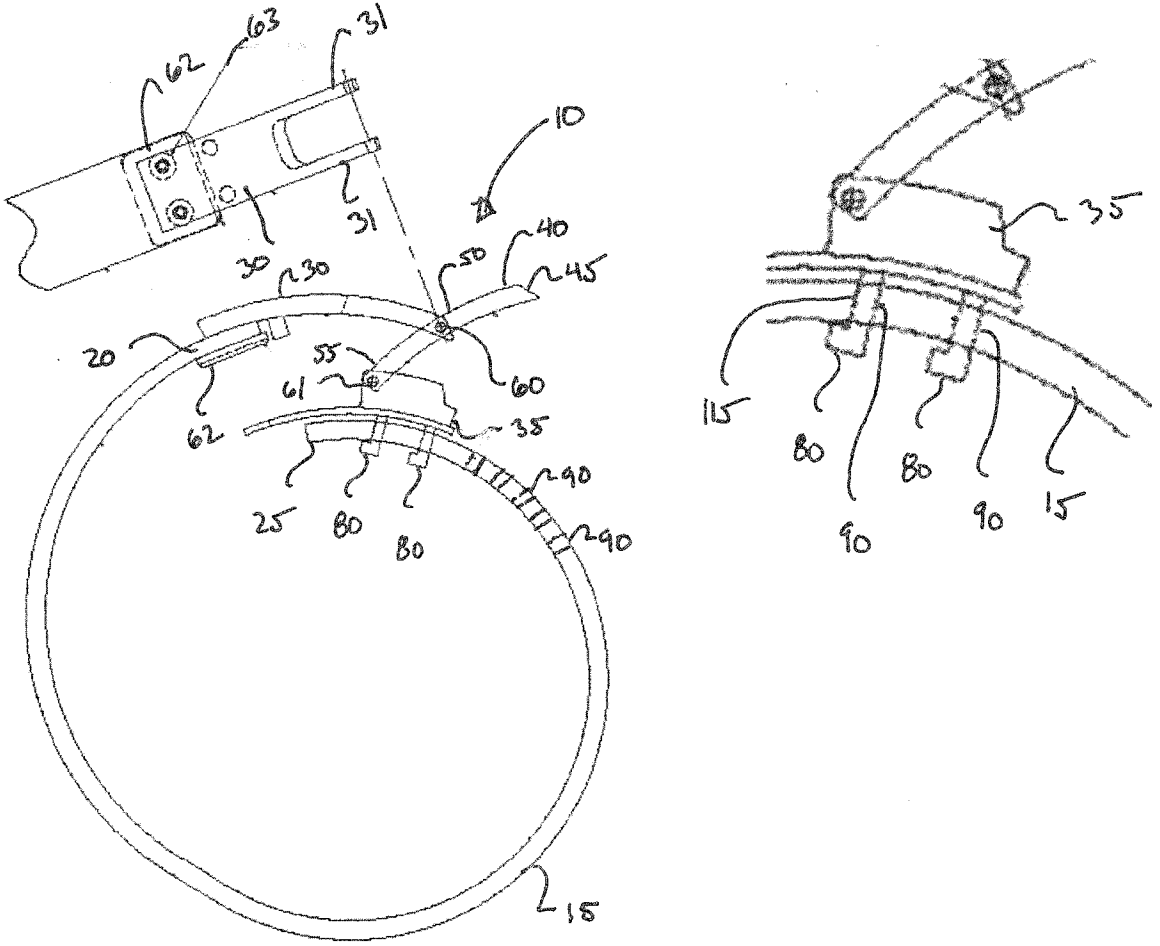
FIG. 1 is a perspective view of the buckle system including the belt and linkages.

Referring to the Figures, there is shown an embodiment that includes a buckle system 10 for a weight belt 15. The weight belt 15 includes a first end 20 and a second end 25. The buckle system 10 includes a first linkage member 30, a second linkage member 35, and a middle linkage member 40. The middle linkage member includes a free end 45, a middle portion 50, and a pivot end 55.

The first linkage member 30 of the buckle system 10 is pivotally attached to the middle linkage member 40 at a first pivot point 60 at the middle portion 50. The second linkage member 35 is pivotally attached at a second pivot 61 at the pivot end 55 of the middle linkage member 40. The pivots 60, 61 may include a hole and hinge pin. However, other pivot designs known to those skilled in the art can be utilized.

Figure 2:
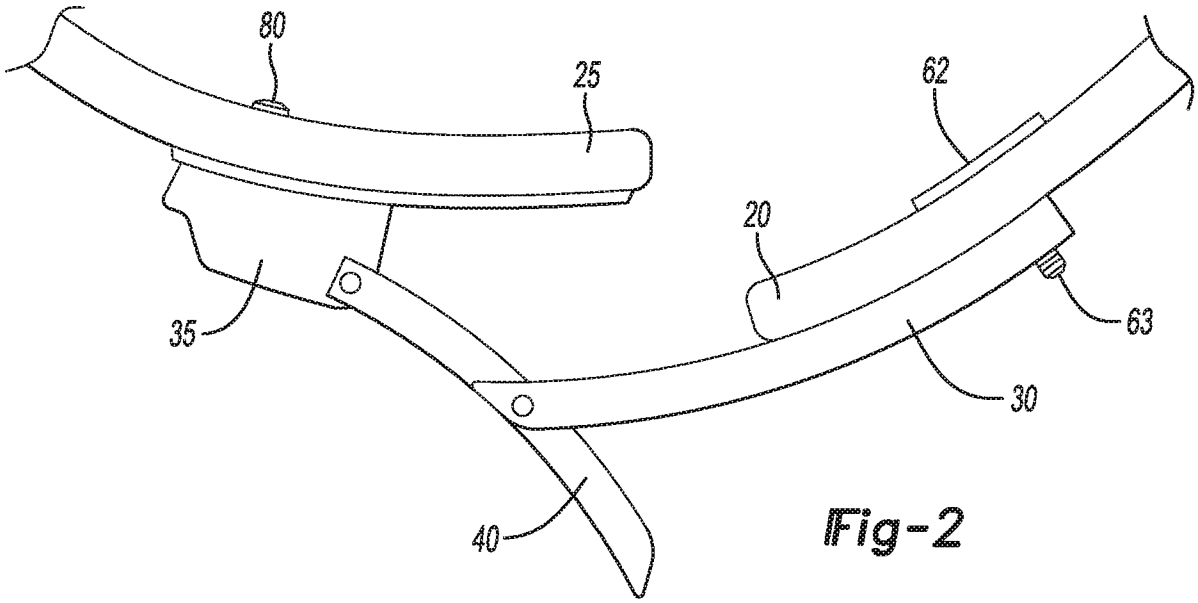
FIG. 2 is a partial top view of the belt and linkages in a first open position.
Figure 3:
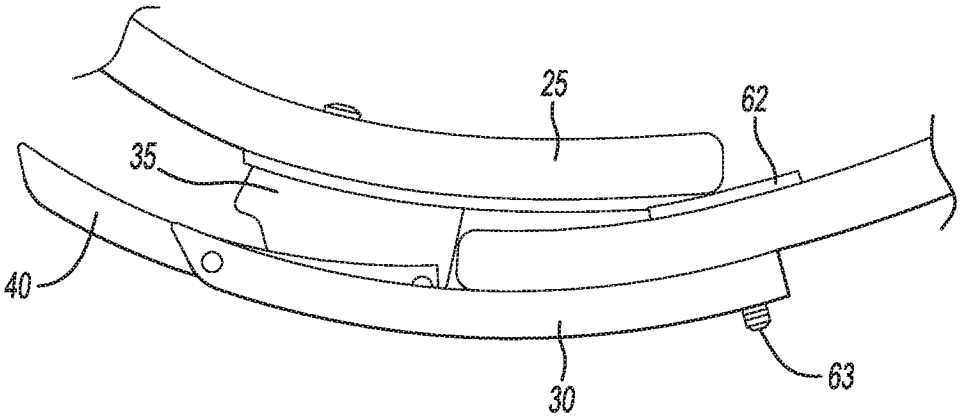
FIG. 3 is a partial top view of the belt and linkages in a second closed position.
Figure 4:
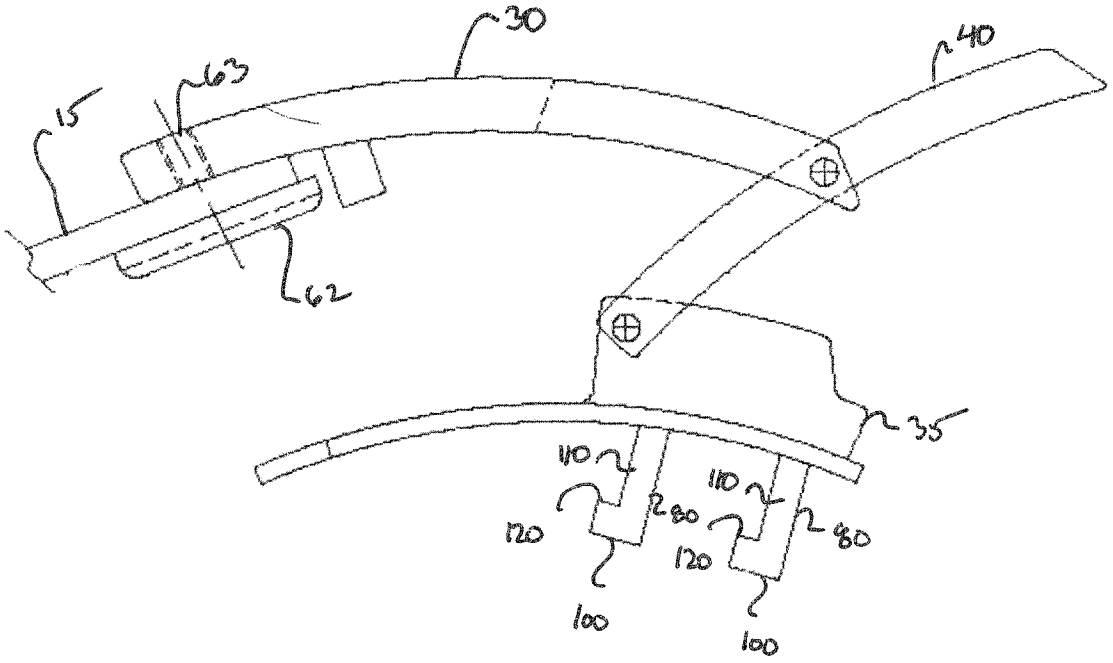
FIG. 4 is a partial view of the linkages attached to the first end of the belt.
Figure 5:
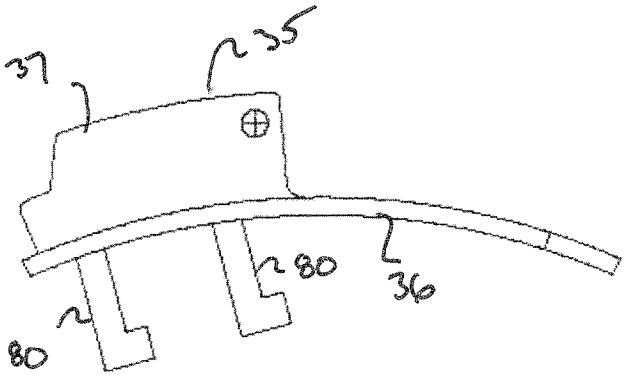
FIG. 5 is view of the second linkage member.
Figure 8:
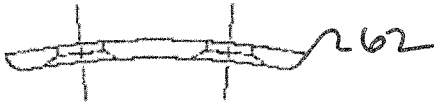
FIG. 8 is a view of a back plate.

When the first linkage member 30 and second linkage member 35 are attached to their respective first end 25 and second end 25, the second end 20 has clearance to be positioned underneath the first end 20 of the weight belt 15 and the buckle system 10 thereby allowing free operation to move the middle linkage member 40 from a first position as best shown in FIG. 2 to a second position as best shown in FIG. 3 enabling the weight belt 15 to be moved from the open position to the closed position thereby tightening the weight belt 15.

The first linkage member 30 is fixedly attachable to the first end 20 of the weight belt 15. In one aspect, the fixed attachment is provided by a back plate 62 and threaded fasteners 63. The back plate 62 may be disposed on an on opposite side of the weight belt 15 as compared to the first linkage member 30. The back plate 62 may be attached to the first linkage member 35 by threaded fasteners 63 which extend through the weight belt 15. Other fixed attachments can be used such as rivets, snapping or clipping members, or any other attachment known to those skilled in the art.

The second linkage member 35 may be removably attachable to the second end 25 of the weight belt 15. In one aspect, an L-shaped extension 80 which protrudes from the second linkage member 35 and a plurality of holes 90 in the weight belt 15 running along the circumference of the weight belt 95 may be utilized to removably attach the second linkage member 35 to the second end 25 of the weight belt 15. The L-shaped extension 80 may be inserted into the hole 90 such that the bottom portion 100 of the L-shaped extension 80 is disposed beyond the hole 90 thereby leaving a top portion 105 of the L-shaped extension 80 disposed within the hole 90. When the belt is tightened and a tension is applied, the L-shaped extension 80 is secured within the hole 90 by a first face 110 of the L-shaped extension 80 abutting an inner surface 115 of the hole 90 and a second face 120 of the L-shaped extension 80 abutting an inner surface of the belt 125.

The weight belt 15 includes the plurality of holes 90 running along the circumference of the weight belt 15 to allow the weight belt 15 to be set up for a variety of users having different body sizes and types without the need of removing any fixed hardware. For example, if a relatively skinny user were to use the weight belt 15 the L-shaped extension 80 could be fitted to a hole 90 closer to the first end 20 of the weight belt 15 as compared to a larger user of the weight belt 15 who would use a hole 90 farther from the first end 20 of the weight belt 15.

To remove the L-shaped extension 80 from the hole 90, tension on the weight belt 15 may be released, for example by moving the free end 45 of the middle linkage member 40 from the second position to the first position. After tension is removed the bottom portion 100 of the L-shaped extensions 80 can be aligned with the holes 90 and be removed.

The first linkage member 30 may include a pair of first linkage extensions 31 best seen in FIG. 1. The pair of first linkage extensions 31 extends away from the first end 20 of the weight belt 15. The middle linkage member 40 is disposed between the pair of first linkage extensions 31.

The second linkage member 35 includes a base plate 36 and a body portion 37. The body portion 37 extends generally perpendicular from the base plate 36.

Figure 6:
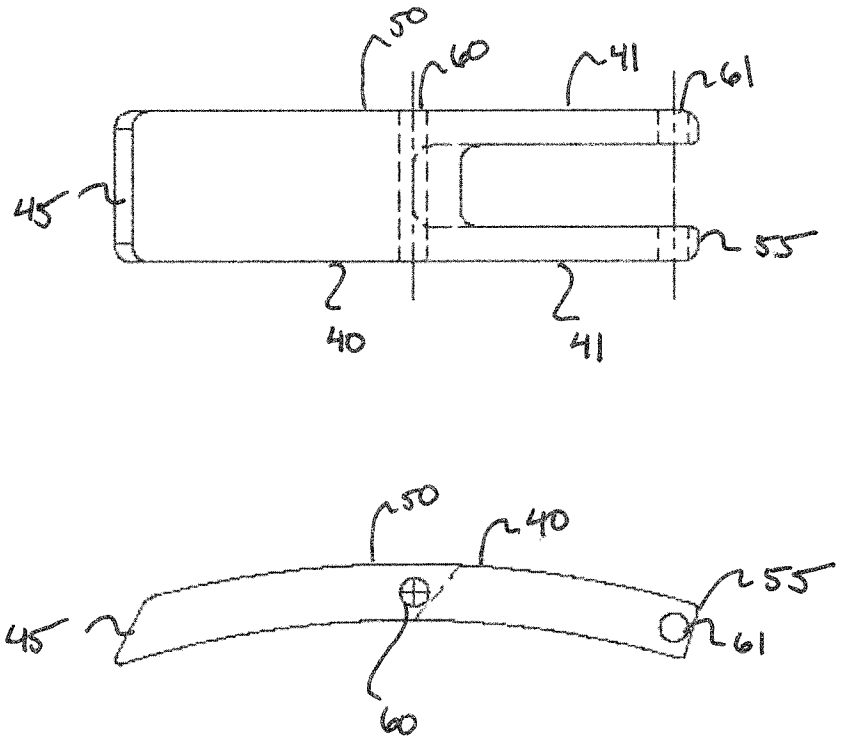
FIG. 6 is a view of the middle linkage member.
Figure 7:
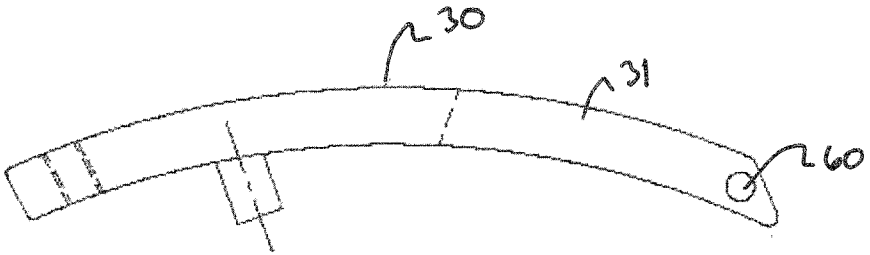
FIG. 7 is a view of the first linkage member.

The middle linkage member 40 may include a pair of middle linkage extensions 41. The pair of middle linkage extensions 41 best seen in FIG. 6 extend generally from the middle portion 50 to the pivot end 55 of the middle linkage member 40. The body portion 37 is disposed between the pair of middle linkage extensions 41.

In one aspect, the first linkage member 30, the middle linkage member 30 and the base plate 36 of the second linkage member 35 all have a curved profile. This curved profile helps to secure the buckle system 10 in the closed position. The curved profile further provides a more ergonomic fit with the user by creating a shape of the buckle system 10 that is closer to the shape of the torso of the user.

The first linkage member 30, second linkage member 35, and middle linkage member 40 may be formed of various materials including metals, plastics or composite materials. Various forming operations may be utilized to create the various components.

The weight belt 15 may be constructed from multiple layers of leather cut to size and stitched together to form a laminate. It is appreciated the weight belt 15 can be made of any material known to those skilled in the art, so long as that material is flexible enough to be wrapped around a user's torso and rigid enough to provide the desired support to the users for the workout or weight lifting activities being performed.

The invention has been described in an illustrative manner. It is to be understood that the terminology which has been used is intended to be in the nature of words of description rather than limitation. Many modifications and variations of the invention are possible in light of the above teachings. Therefore, within the scope of the appended claims, the invention may be practiced other than as specifically described.

The invention claimed is:

1. A buckle system for a weight belt having a first end and a second end, the buckle system comprising:

a flexible weight belt for wrapping around a torso of a user including a plurality of holes formed along a circumference of the weight belt on the second end of the weight belt;

a first linkage member fixedly attachable to the first end of the weight belt;

a second linkage member including a plurality of L-shaped extensions, the L-shaped extensions removably insertable into various of the plurality of holes adjusting a size of the weight belt in a closed position wherein in said closed position the second end of the weight belt has clearance to be positioned under the first end of the weight belt;

a middle linkage member having a free end, a middle portion, and a pivot end;

the first linkage member being pivotally attached to the middle linkage member at the middle portion of the middle linage member, the second linkage member being pivotally attached to the pivot end of the middle linkage member; and wherein actuation of the free end of the middle linkage member from a first position to a second position causes the buckle system to be transitioned from an open position to said closed position, thereby tightening the weight belt when the first linkage member is attached to the first end of the weight belt, and second linkage member is attached to the second end of the weight belt.

2. The buckle system of claim 1 wherein the L-shaped extensions are coplanar to a circumference of the weight belt.

3. The buckle system of claim 1 wherein the second linkage member includes a base plate portion, and a body portion.

4. The buckle system of claim 3 wherein the L-shaped extensions extend generally normal to the base plate portion.

5. The buckle system of claim 3 wherein the first linkage, the base plate portion of the second linkage, and the middle linkage include a curved profile.

* * * * *